US008840330B2

(12) United States Patent
Shirotori et al.

(10) Patent No.: US 8,840,330 B2
(45) Date of Patent: Sep. 23, 2014

(54) CUTTER AND PRINTER WITH CUTTER

(75) Inventors: Motoyoshi Shirotori, Shiojiri (JP); Kenichi Hirabayashi, Shiojiri (JP)

(73) Assignee: Seiko Epson Corporation

( * ) Notice: Subject to any disclaimer, the term of this patent is extended or adjusted under 35 U.S.C. 154(b) by 551 days.

(21) Appl. No.: 12/716,210

(22) Filed: Mar. 2, 2010

(65) Prior Publication Data

US 2010/0221057 A1 Sep. 2, 2010

(30) Foreign Application Priority Data

Mar. 2, 2009 (JP) ..... 2009-047663

(51) Int. Cl.

| | |
|---|---|
| ***B41J 11/00*** | (2006.01) |
| ***B41J 11/70*** | (2006.01) |
| ***B41J 13/00*** | (2006.01) |
| ***B26D 7/08*** | (2006.01) |
| ***B41J 11/66*** | (2006.01) |
| ***B26D 7/32*** | (2006.01) |
| ***B26D 1/30*** | (2006.01) |
| *B26D 5/14* | (2006.01) |

(52) U.S. Cl.

CPC . *B41J 11/66* (2013.01); *B26D 7/08* (2013.01); *B26D 7/32* (2013.01); *B26D 1/305* (2013.01); *B26D 5/14* (2013.01)

USPC ..... 400/621; 400/642; 271/171

(58) Field of Classification Search

CPC ..... B65H 29/48; B65H 29/52; B41J 13/0036; G07B 5/02; G07B 3/02

USPC ..... 400/583, 621, 642, 646; 271/142, 143, 271/171; 83/165, 167, 694

IPC ..... B65H 31/00

See application file for complete search history.

(56) References Cited

U.S. PATENT DOCUMENTS 5,791,642 A * 8/1998 Sawano et al. ..... 270/58.01
6,073,925 A * 6/2000 Sato ..... 271/171

(Continued)

FOREIGN PATENT DOCUMENTS

CN 1907661 A 2/2007
JP 06-009124 A 1/1994

(Continued)

*Primary Examiner* — Ren Yan
*Assistant Examiner* — Marissa Ferguson Samreth
(74) *Attorney, Agent, or Firm* — Kilpatrick Townsend & Stockton LLP

(57) ABSTRACT

A cutter and a printer having a cutter prevent the paper pieces cut off by the cutter from collecting at the paper exit from which the cut-off pieces are discharged. A stage surface 40defines the bottom edge 5*a* of the paper exit 5. A sloped guide surface 41 is formed sloping down from the downstream side of the stage surface 40. A first side wall 42 determines where one side of the width of the paper passes over the stage surface 40 and the sloped guide surface 41. A second side wall 43 determines where the other side of the width of the paper passes. A protrusion 47 is formed on the first side wall 42 protruding toward the second side wall 43.When label paper 11 is cut, the cut-off portion 11*c* is deposited on the stage surface 40 covering the top of the protrusion 47. As a result, the cut-off portion 11*c* is made unstable by the protrusion 47 immediately after being deposited on the stage surface 40, and slides down easily. The cut-off portion 11*c* slides down from the stage surface 40 along the sloped guide surface 41, and is discharged smoothly from the paper exit 5.

10 Claims, 6 Drawing Sheets

(56) References Cited

U.S. PATENT DOCUMENTS

| | | | | |
|---|---|---|---|---|
| 6,474,883 | B1 * | 11/2002 | Kawakami et al. | 400/613 |
| 6,712,219 | B2 * | 3/2004 | Kobayashi et al. | 209/534 |
| 7,563,045 | B2 * | 7/2009 | Nagata | 400/693 |
| 7,731,437 | B2 | 6/2010 | Shirotori et al. | |
| 7,771,134 | B2 * | 8/2010 | Ohashi | 400/621 |
| 7,854,427 | B2 * | 12/2010 | Tsujinishi | 271/171 |
| 8,177,213 | B2 * | 5/2012 | Hirabayashi | 270/58.07 |
| 2006/0170983 | A1 | 8/2006 | Ohashi | |
| 2007/0068222 | A1 * | 3/2007 | Zeng et al. | 73/24.06 |
| 2009/0129846 | A1 * | 5/2009 | Ishida et al. | 400/613 |
| 2010/0202819 | A1 | 8/2010 | Shirotori et al. | |

FOREIGN PATENT DOCUMENTS

| | | | | |
|---|---|---|---|---|
| JP | 06-226687 | A | 8/1994 | |
| JP | 09-019890 | A | 1/1997 | |
| JP | 11-245465 | A | 9/1999 | |
| JP | 2000-127535 | A | 5/2000 | |
| JP | 2005-053177 | A | 3/2005 | |
| JP | 2006-159665 | * | 6/2006 | B41J 11/70 |

* cited by examiner

CUTTER AND PRINTER WITH CUTTER

This application claims priority under 35 U.S.C. §119 to Japanese Patent Application No. 2009-047663 filed on Mar. 2, 2009, the entire disclosure of which are expressly incorporated by reference herein.

BACKGROUND

1. Technical Field

The present invention relates to a cutter and to a printer having a cutter wherein the bottom edge of the paper exit from which the cut-off ends of recording medium (the cut paper) are discharged is a substantially horizontal surface. More specifically, the invention relates to a cutter and to a printer having a cutter from which the cut-off portions can be discharged after cutting without accumulating at the paper exit.

2. Related Art

Printers that print on recording paper such as roll paper or label paper commonly have a cutter for cutting off the printed portion of the recording paper after printing is completed. The cutter is located at a position on the downstream end part in the transportation direction of the transportation path that passes from the printing position of the print head to the paper exit, and the cut-off portion that is cut off from the recording paper is discharged from the paper exit. Cutters include both scissor cutters that cause a movable knife to pivot in a scissor action to and away from a fixed knife, and guillotine cutters in which the movable knife moves bidirectionally in a straight line to and away from the fixed knife.

A scissor type paper cutter that can be disposed in a printer is taught in Japanese Unexamined Patent Appl. Pub. JP-A-H09-19890. In the cutter taught in JP-A-H09-19890 the fixed knife is disposed with the cutting edge facing up, and the movable knife pivots on a support pin at one end in the cutting direction of the movable knife between a standby position where a specific gap is formed between the cutting edge of the movable knife and the cutting edge of the fixed knife, and a cutting-completed position where the cutting edge of the movable knife and the cutting edge of the fixed knife overlap throughout the entire range of the cutting direction. The paper is inserted on the paper path from the fixed knife side and the cut-off portion is discharged from the movable knife side.

The paper exit disposed to the cutter or a printer with a cutter must have a narrow opening so that foreign matter is not inserted from the outside, and is generally long and narrow in the cutting direction (the paper width direction). More specifically, the bottom edge of the paper exit is commonly positioned slightly below the cutting edge of the fixed knife and the top edge of the paper exit is positioned slightly above the cutting edge of the fixed knife so that the vertical size of the opening is reduced. When the movable knife moves toward the cutting-completed position with this configuration, however, the upstream side end part in the paper discharge direction (transportation direction) of the cut-off portion is pushed below the bottom edge of the paper exit by the downward moving movable knife. The cut-off portion also becomes curled. As a result, when the movable knife returns to the standby position, the cut-off portion may spring up as a result of the resilience of the paper when the paper returns from the curled position.

To prevent the cut-off portion from being pushed down or popping out from the paper exit, the bottom edge of the paper exit may have a substantially level stage surface that extends for a specific width in the cutting direction along the edge of the fixed knife slightly below the cutting edge of the movable knife at the cutting-completed position. Because the stage surface that determines the bottom edge of the paper exit in this configuration is positioned below the cutting edge of the movable knife at the cutting-completed position, the movable knife does not push the upstream end part of the cut-off portion down when cutting, the upstream end part of the cut-off portion is above the bottom edge of the paper exit and is not caused to curl.

However, when the bottom edge of the paper exit is defined by a stage surface, the discharged cut-off portions can easily be left on the stage and collect in a pile when the roll paper inserted between the fixed knife and the movable knife is repeatedly cut into particularly short lengths. When the cut-off portions collect between the fixed knife and the movable knife, the accumulated cut-off portions interfere with the movable knife, preventing the movable knife from moving to the cutting-completed position and causing defective cuts. The movable knife can also bite into the cut-off portions and become unable to move, that is, become locked.

SUMMARY

A cutter and a printer having a cutter according to at least of one embodiment of the present invention can discharge the cut-off portions of paper without them accumulating even when an edge of the paper exit from which the cut-off paper is discharged is determined by a stage.

A first aspect of the invention is a cutter having a fixed knife; a movable knife that moves relative to the fixed knife and cuts paper; a paper exit having opposing surfaces from which the paper is discharged; a stage surface that defines a surface on the bottom side of the paper exit; at least one protruding part disposed to the stage surface; and an inclined guide surface formed at the downstream side of the stage surface in the paper discharge direction extending down in the discharge direction.

Preferably, the protruding part is disposed at a position on the downstream side in the discharge direction from the movable knife.

Further preferably, the distal end of the protruding part is disposed at a position lower than the cutting edge of the fixed knife.

Because the surface on the downstream side of the paper exit is a stage surface in this aspect of the invention, the cut-off portions of paper that are cut by the fixed knife and movable knife and discharged are deposited on the stage surface. So that the cut-off portions do not interfere with the movable knife in the stage surface, a protruding part is disposed to the stage surface on the downstream side of the movable knife. When a cut-off portion is deposited on the stage surface, the cut-off portion is deposited covering the top of the protruding part, that is, resting on the protruding part. The cut-off portion is therefore rendered unstable and unbalanced by the protruding part from the time it is deposited on the stage surface, and can drop down easily.

As a result, the unbalanced cut-off portions do not accumulate on the stage surface, and slide down over the inclined guide surface formed to the downstream end of the stage surface. Yet further, because the distal end of the protruding part is at a position lower than the cutting edge of the fixed knife, the cut-off portion is easily tilted to the downstream side, and can slide down smoothly. Because the cut-off portions thus do not accumulate on the stage surface, interference between accumulated cut-off portions and the movable knife and cutting problems resulting therefrom can be avoided. The movable knife is also prevented from biting into a stack of cut-off portions and becoming locked.

Further preferably, the movable knife can pivot on a pivot axis at one end part of the movable knife, and the protruding part is disposed at least on the pivot axis side of the stage surface.

More specifically, when the cutter is a scissor cutter, the pivot axis side, which is the side of the stage surface at one end of the movable knife, is the side of the paper web that is cut first by the pivoting movable knife, and is the part of the stage surface on which the cut-off portion is first deposited. By disposing a protruding part in this portion, the cut-off portion is made unstable and can tilt from the moment this part of the paper touches the stage surface, and the cut-off part of paper can be made to easily slide down the inclined guide surface.

In another aspect of the invention, the protruding part is formed at the upstream side of the stage surface in the discharge direction.

If the protruding part is formed in this area of the stage surface, the position of the protruding part will usually be on the upstream side of the center of gravity of the cut-off portion deposited on the stage surface. The cut-off portion therefore easily loses balance to the downstream side, and the cut-off portion can slide easily down over the inclined guide surface.

In another aspect of the invention, the protruding part is a protrusion formed in unison with the stage surface.

With this configuration the protruding part can be formed together with the stage surface.

A cutter according to another aspect of the invention preferably also has a first side wall that determines the position of the paper passing over the stage surface on the pivot axis side of the movable knife, and can move over the stage surface widthwise to the paper; and a second side wall that determines the position of the side of the paper on the distal end side of the movable knife; and the protruding part is a protrusion that is disposed on the first side wall protruding toward the second side wall.

When thus configured, when the width of the paper to be cut changes and the side walls are adjusted accordingly, the protrusion formed on the first side wall on the side of the paper that is cut first will always be set to a position where it is covered from above by the cut-off portion (that is, the position where the cut-off portion is deposited). The cut-off portion deposited on the stage surface can thus be easily made to lose balance.

Further preferably, this aspect of the invention also has a linkage mechanism that can move the second side wall in conjunction with the first side wall the same amount in the opposite direction as the first side wall, and a notch is rendered in the second side wall on the top edge part thereof on the inside surface facing the first side wall.

In this aspect of the invention, when the side on the first side wall side of the cut-off portion that is cut first drops onto the inclined guide surface first, the side of the cut-off portion on the second side wall side is prevented from riding onto the second side wall, and the cut-off portion can be prevented from resting on the stage surface on top of the second side wall.

In another aspect of the invention, the protruding part is a protrusion formed along the discharge direction from the stage surface to the inclined guide surface, and the top surface of said protrusion slopes down in the discharge direction.

Another aspect of the invention is a printer with a cutter, including a case; a cover that opens and closes to the case; and the cutter described above, disposed with the movable knife on the case side and the fixed knife on the cover side.

The printer may be configured, for example, with a roll paper compartment for storing roll paper inside the case so that the roll paper can be set in the roll paper compartment by opening the cover. If the movable knife is disposed on the case side and the fixed knife is disposed on the cover side, the paper pulled out from the paper roll can be easily set between the fixed knife and the movable knife by simply opening the cover and loading the roll paper.

Effect of at Least of One Embodiment of the Invention

With the cutter and a printer having a cutter according to at least of one embodiment of the present invention, the downstream side of the paper exit is determined by a stage surface, and the pieces of paper that are cut by the fixed knife and movable knife are deposited on the stage surface. Because a protruding part is disposed to the part of the stage surface that does not interfere with the movable knife in the stage surface, when a cut-off portion is deposited on the stage surface, the cut-off portion is deposited covering the top of the protruding part, that is, resting on the protruding part. The cut-off portion is therefore rendered unstable and unbalanced by the protruding part from the time it is deposited on the stage surface, and can drop down easily.

The unbalanced cut-off portions therefore do not accumulate on the stage surface, and slide down over the inclined guide surface formed to the downstream end of the stage surface. Because the cut-off portions thus do not accumulate on the stage surface, interference between accumulated cut-off portions and the movable knife and cutting problems resulting therefrom can be avoided. The movable knife is also prevented from biting into a stack of cut-off portions and becoming locked.

Other objects and attainments together with a fuller understanding of the invention will become apparent and appreciated by referring to the following description and claims taken in conjunction with the accompanying drawings.

DESCRIPTION OF EMBODIMENTS

A printer with a cutter according to a preferred embodiment of the present invention is described below with reference to the accompanying figures.

General Configuration

Figure 1A:
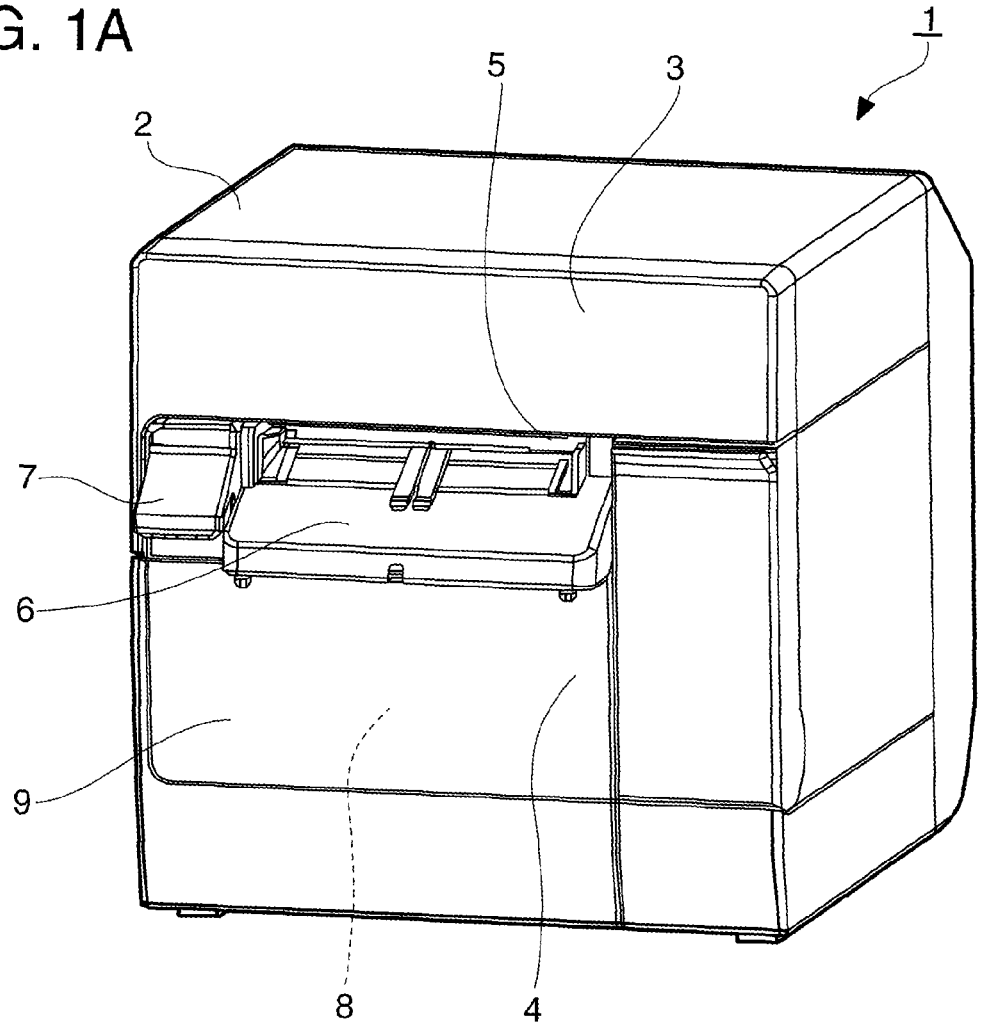
FIG. 1A is an oblique view of a printer with a cutter.
Figure 1B:
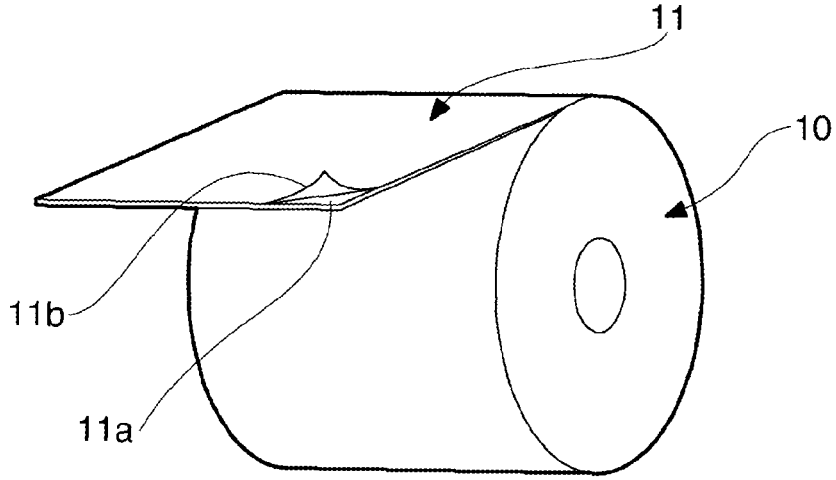
FIG. 1B is an oblique view of roll paper.
Figure 2:
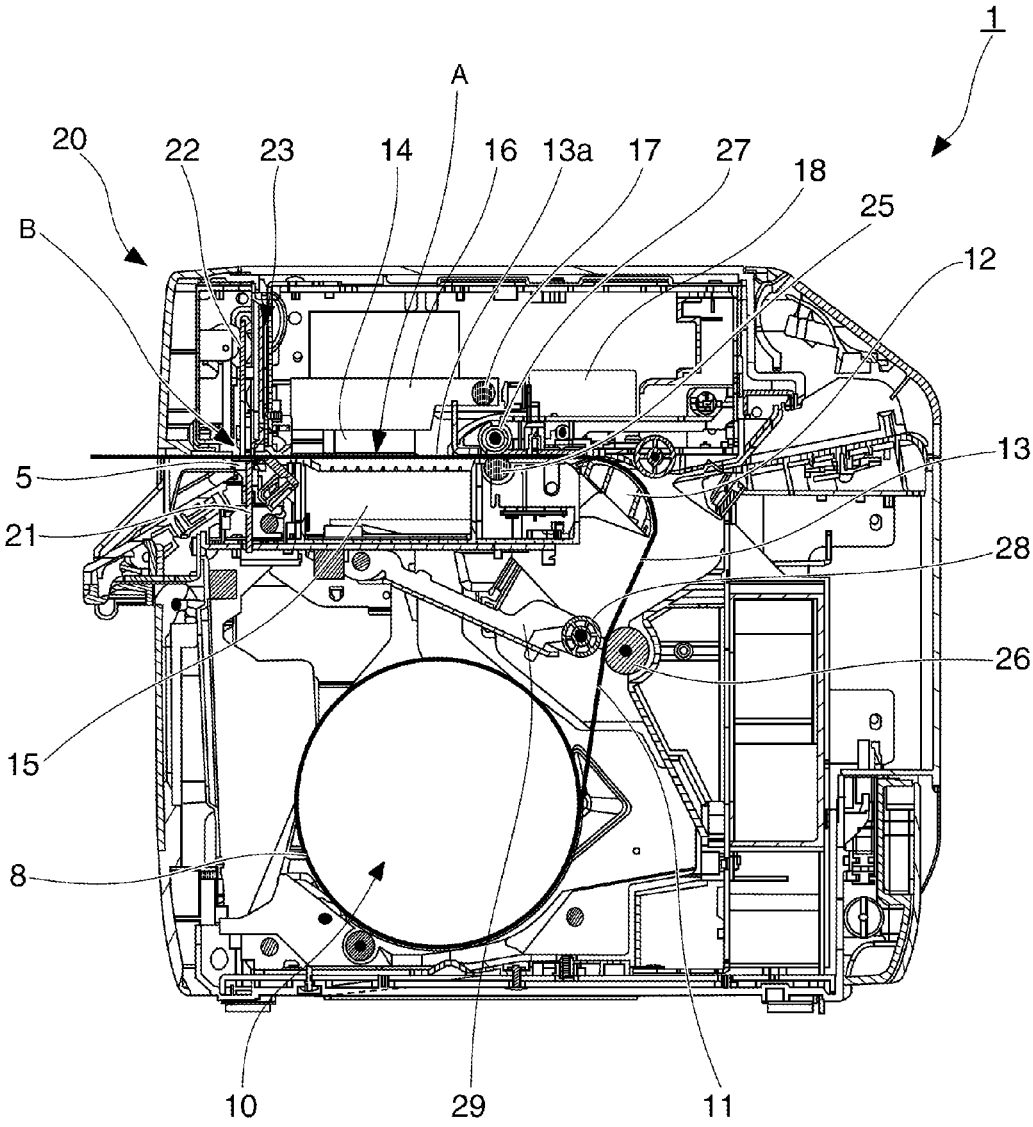
FIG. 2 is a section view showing the configuration of the inside of a printer with a cutter.

FIG. 1A is an oblique view of a printer with a cutter according to this embodiment of the invention, and FIG. 1B is an oblique view of roll paper that is used in the printer with the cutter. FIG. 2 is a section view showing the internal configuration of the printer with a cutter.

As shown in FIG. 1A, the printer with automatic cutter 1 has a printer housing 2 having a generally rectangular box-like shape. The front of the printer housing 2 is covered by a top case 3 and a bottom case 4, and has a rectangular paper exit 5 of a specific width formed therebetween. A paper exit guide 6 protrudes to the front below the paper exit 5, and a opening/closing lever 7 is disposed beside the paper exit guide 6. An opening to a roll paper compartment 8 formed inside the printer housing 2 is formed in the bottom case 4 below the paper exit guide 6 and opening/closing lever 7, and this opening is closed by an access cover 9. When the opening/closing lever 7 is operated and the access cover 9 opened, roll paper 10 can be loaded (set) into the roll paper compartment 8.

Various types of paper can be used as the roll paper 10, including roll paper having a continuous web of paper of a specific width wound into a roll, rolls of label paper having labels of a predetermined shape (die-cut labels (that is, individually cut labels)) affixed at a predetermined interval on the surface of a continuous web liner of a predetermined width, and rolls of label paper having a continuous web of label stock of a predetermined width affixed to the surface of a continuous web liner of a predetermined width (continuous label paper (label paper on which the label stock is not cut into individual labels, may also include butt-cut labels)).

As shown in FIG. 1B, this embodiment of the invention uses label paper 11 having a continuous label (or butt-cut labels) 11*b* affixed to the web liner 11*a* wound into a roll by way of example.

As shown in FIG. 2, the roll paper compartment 8 is formed in the center between the side walls of the printer housing 2 inside the printer with automatic cutter 1. The roll paper 10 is stored in the roll paper compartment 8 with the roll paper 10 resting on its side horizontally with its axis widthwise to the printer.

The label paper 11 web delivered from the roll paper 10 loaded in the roll paper compartment 8 is pulled diagonally upward, then curves around a curved tension guide 12, and is then conveyed through a paper transportation path 13 that extends horizontally to the paper exit 5. The tension guide 12 is urged upward by the force of a spring, and a specific tension is applied to the label paper 11 passing around the tension guide 12.

The horizontal portion of the paper transportation path 13 is directly above the roll paper compartment 8. An inkjet print head 14 and vacuum platen 15 are disposed in mutual opposition with a specific gap therebetween in this horizontal transportation path portion 13*a*, and the printing position A of the inkjet print head 14 is determined by the vacuum platen 15. The inkjet print head 14 is carried on a carriage 16, and the carriage 16 is moved bidirectionally widthwise to the printer along a carriage guide shaft 17 by means of a carriage motor 18.

A cutting position B is disposed on the downstream side in the paper transportation direction of the paper transportation path 13 from the printing position A. The automatic cutter 20 is disposed to the cutting position B, and the label paper 11 printed at the printing position A is cut widthwise to the printer (across the paper width) at this cutting position B.

The automatic cutter 20 includes a fixed knife 21 disposed with the cutting edge facing up, a movable knife 22 disposed with the cutting edge facing down, a movable knife drive mechanism 23, and the paper exit 5. The paper exit 5 of the automatic cutter 20 is the paper exit 5 of the printer with automatic cutter 1. The fixed knife 21 and the movable knife 22 are disposed so that the cutting direction is aligned with the printer width (the paper width). The fixed knife 21 is disposed on the upstream side in the paper transportation direction (paper discharge direction) of the paper transportation path 13, the movable knife 22 is disposed on the downstream side in the paper transportation direction, and the paper exit 5 is on the downstream side of the movable knife 22.

The transportation mechanism for conveying the label paper 11 along the paper transportation path 13 includes a paper feed roller 25, a delivery roller 26, and a paper feed motor and delivery motor for rotationally driving these rollers. The paper feed roller 25 is located on the upstream side of the printing position A on the paper transportation path 13, and is rotationally driven by a paper feed motor. A first pressure roller 27 is pressed against and rotates in conjunction with the paper feed roller 25.

The delivery roller 26 is for supplying label paper 11 from the roll paper compartment 8, and is located on the paper transportation path 13 on the upstream side in the paper transportation direction from the tension guide 12. The delivery roller 26 is rotationally driven by a delivery motor, and a second pressure roller 28 is pressed against and rotates in conjunction with the delivery roller 26. The second pressure roller 28 is attached to a distal end part of a pressure lever 29 that extends toward the back from a position below the vacuum platen 15. This pressure lever 29 is pushed down by the force of a spring, and is urged to the delivery roller 26.

The label paper 11 pulled from the roll paper 10 in the roll paper compartment 8 is conveyed by the transportation mechanism through the paper transportation path 13. The inkjet print head 14 prints on the label side of the paper at the printing position A. The automatic cutter 20 cuts the label paper 11 at the cutting position B so that the cut-off portion 11*c* contains the printed area. A label of a desired length is thus issued from the paper exit.

Automatic Cutter

Figure 3:
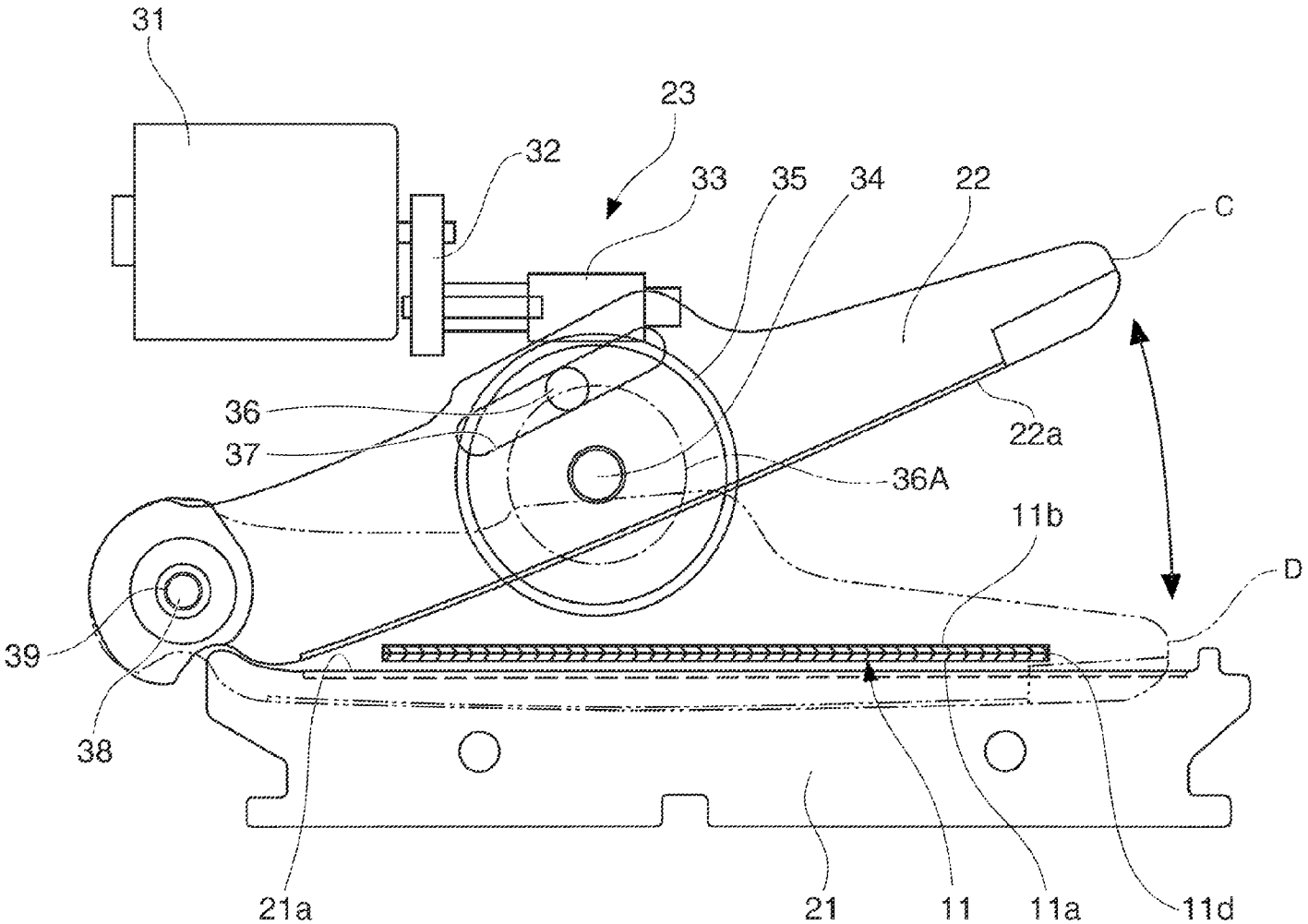
FIG. 3 is a schematic diagram of the cutter.

FIG. 3 is a schematic view of the fixed knife 21, movable knife 22, and movable knife drive mechanism 23 of the automatic cutter 20.

In this embodiment of the invention the automatic cutter 20 is a scissor cutter. Torque from a cutter motor 31 causes the movable knife 22 to pivot up and down on a pivot axis at one end thereof widthwise to the printer between a standby position C (denoted by the solid line in FIG. 2) where a specific gap is formed between the cutting edge 22*a* of the movable knife 22 and the cutting edge 21*a* of the fixed knife 21, and a cutting-completed position D (denoted by the imaginary line in FIG. 3) where the cutting edge 22*a* of the movable knife 22 and the cutting edge 21*a* of the fixed knife 21 overlap throughout the entire range thereof widthwise to the printer (the cutting direction).

The movable knife drive mechanism 23 has a worm gear 33 that is rotationally driven by the cutter motor 31 through a power transfer mechanism 32. The worm gear 33 meshes with a worm wheel 35 that is affixed to rotate freely on a support shaft 34. The rotational motion of the worm wheel 35 is converted by a crank mechanism to the vertical pivoting motion of the movable knife 22.

The crank mechanism includes a crank pin 36 attached perpendicularly to the round end face of the worm wheel 35 at a position offset from the axis of rotation, and a straight slide channel 37 of a specific length formed in the movable knife 22. The crank pin 36 is inserted so that it can slide in the slide channel 37, and rotates along a circular path of rotation 36A denoted by the dot-dash line in FIG. 3 in conjunction with rotation of the worm wheel 35.

The length of the slide channel 37 is set so that it can move tracking the movement of the crank pin 36 vertically and widthwise to the printer, and the movable knife 22 can pivot vertically on the support shaft 38 on which one end thereof is supported as the pivot axis.

A coil spring 39 that pushes the movable knife 22 to the fixed knife 21 is disposed to the support shaft 38, and the compression force between the cutting edge 22*a* of the movable knife 22 and cutting edge 21*a* of the fixed knife 21 is held to the compression force required to cut the label paper 11 by means of the urging force of this coil spring 39.

When the worm wheel 35 turns one revolution, the movable knife 22 travels once back and forth between the standby position C and the cutting-completed position D, and can cut the label paper 11 disposed between the movable knife 22 and the fixed knife 21 across the width of the paper.

Note that the fixed knife 21 is attached to the access cover 9 of the bottom case 4, and moves in front of the printer housing 2 together with the access cover 9 when the access cover 9 opens. The movable knife 22 is disposed on the top case 3 side. Therefore, when the access cover 9 is opened and the roll paper 10 is loaded in the roll paper compartment 8, the label paper 11 pulled off from the roll paper 10 can be easily set between the fixed knife 21 and the movable knife 22.

Figure 4A:
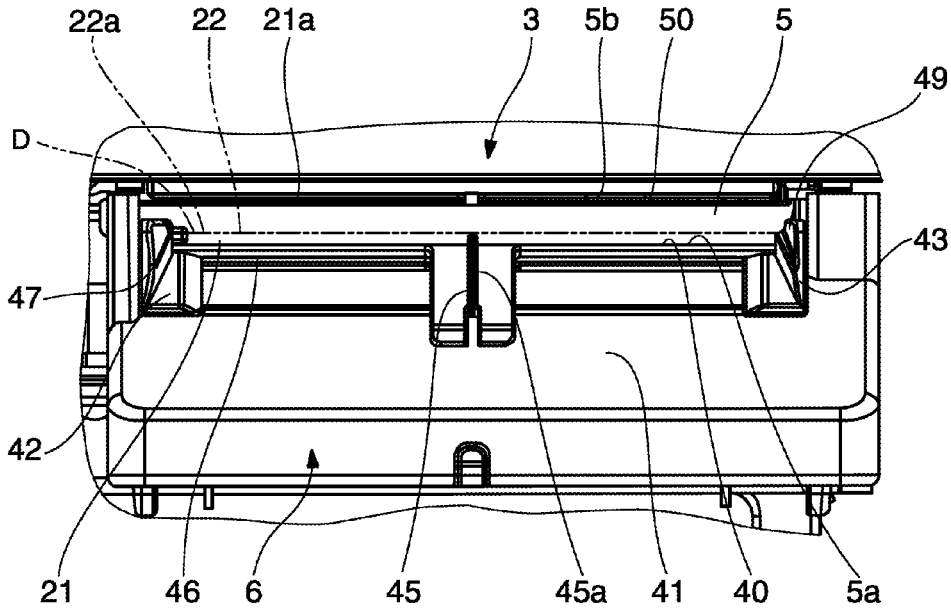
FIG. 4A is a front view showing the part around the paper exit.
Figure 4B:
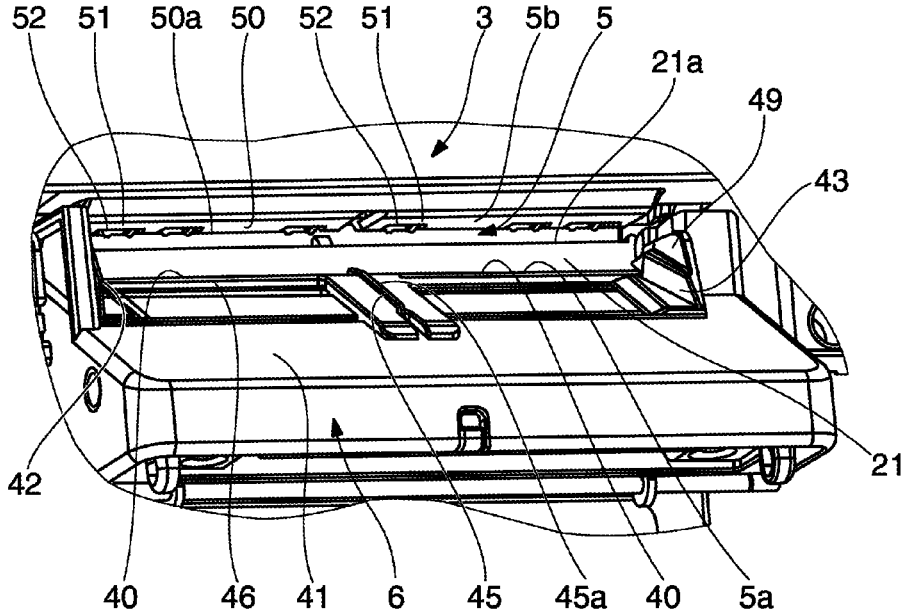
FIG. 4B is an oblique view showing the part around the paper exit.
Figure 5A:
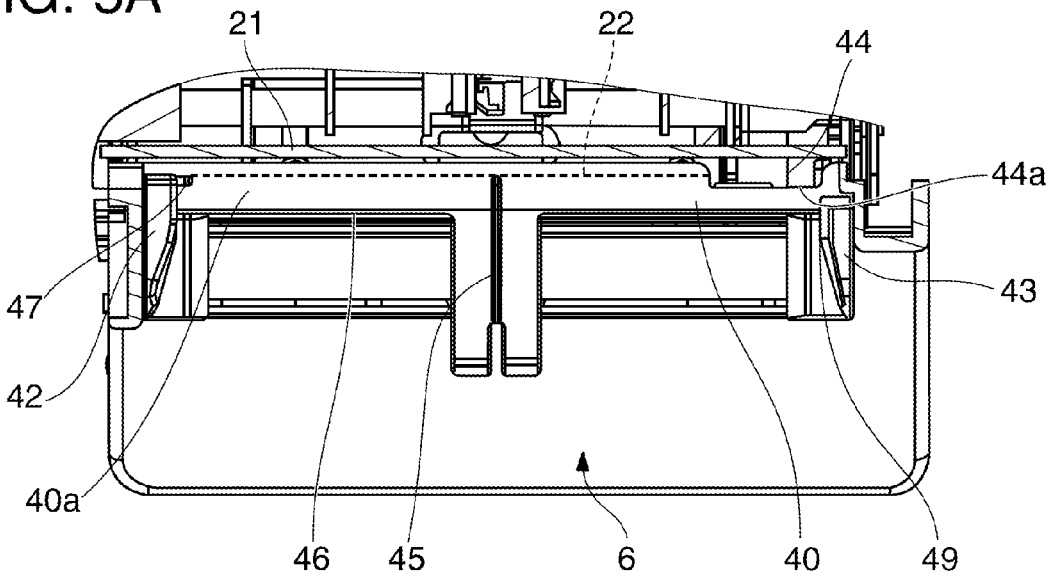
FIG. 5A is a plan view of the part around the paper exit guide.
Figure 5B:
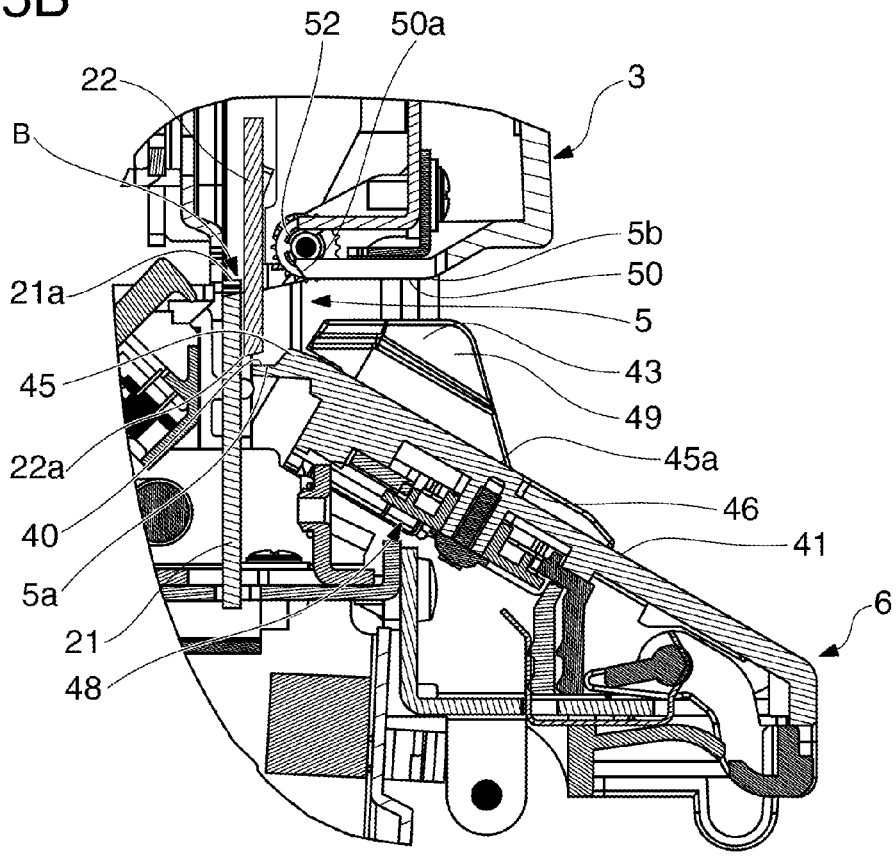
FIG. 5B is a vertical section view of the part around the paper exit in the part around the paper exit guide.

The paper exit 5 is described next with reference to FIG. 4A to FIG. 5B. FIG. 4A is a front view of the part around the paper exit 5, and FIG. 4B is an oblique view showing the part around the paper exit 5 as seen from diagonally below. FIG. 5A is a plan view of the part around the paper exit guide 6 with the top case 3 and movable knife 22 removed, and FIG. 5B is a vertical section view of the part around the paper exit 5 through the paper transportation direction of the paper transportation path 13 when the fixed knife 21 is in the cutting-completed position D.

The paper exit 5 is a narrow, rectangular opening that is long widthwise to the printer (widthwise to the paper). The bottom edge 5*a* of the paper exit 5 is rendered by the paper exit guide 6, and the top edge 5*b* of the paper exit 5 is rendered by the top case 3.

The paper exit guide 6 has a stage surface 40 of a specific width extending horizontally widthwise to the printer along the edge of the fixed knife 21 at a position slightly lower than the cutting edge 22*a* of the movable knife 22 in the cutting-completed position D, and a sloped guide surface 41 that extends downward toward the downstream side of the paper transportation direction from downstream end edge of the stage surface 40. The paper exit guide 6 also has a first side wall 42 that defines one side (the side at which the movable knife 22 pivots) of the paper exit guide 6 widthwise to the printer where the label paper 11 passes over the stage surface 40 and the sloped guide surface 41, and a second side wall 43 that defines the other side (the side at the distal end of the movable knife 22). The stage surface 40 defines the bottom edge 5*a* of the paper exit 5.

As shown in FIG. 5A, a rectangular notched opening 44 (recessed part) that is narrow and long widthwise to the printer is formed at the upstream end edge on the other end part of the stage surface 40 widthwise to the printer. The notched opening 44 is formed to include a stage surface part 40*a* on the downstream side of the movable knife 22 denoted by the dotted line. More specifically, the downstream edge 44*a* of the notched opening 44 is located downstream in the paper transportation direction from the movable knife 22.

A long, narrow protrusion 45 extending in the paper transportation direction from the stage surface part 40*a* to the sloped guide surface 41 is formed in the middle of the stage surface 40 widthwise to the printer. The top surface 45*a* of the protrusion 45 slopes downward to the downstream side in the paper transportation direction.

The first side wall 42 is configured so that it can move widthwise to the printer sliding on the stage surface part 40*a*, the sloped guide surface 41, and the stepped surface 46 between the stage surface part 40*a* and the sloped guide surface 41. A protrusion 47 that projects to the second side wall 43 side is formed at an upstream end part of the first side wall 42. The top end of this protrusion 47 is at a height that is lower than the cutting edge 21*a* of the fixed knife 21.

The second side wall 43 is configured so that it can slide widthwise to the printer (widthwise to the paper) sliding on the surface part of the stage surface part 40*a* on the downstream side in the paper transportation direction from the downstream edge 44*a* of the notched opening 44, the sloped guide surface 41, and the stepped surface 46.

As shown in FIG. 5B, a linkage mechanism 48 is disposed on the back side of the sloped guide surface 41. This linkage mechanism 48 causes the second side wall 43 to move the same distance in the opposite direction as the first side wall 42 when the first side wall 42 is moved widthwise to the printer, the second side wall 43 thus moves in conjunction with movement of the first side wall 42. Different paper widths can thus be accommodated. The top part on the inside face of the second side wall 43 facing the first side wall 42 is cut away, rendering a notched step 49.

A paper exit ceiling 50 extending horizontally opposite the stage surface 40 at substantially the same height as the cutting edge 21*a* of the fixed knife 21 is formed at the bottom edge part of the top case 3 on the downstream side of the movable knife 22. This paper exit ceiling 50 defines the top edge 5*b* of the paper exit 5.

The upstream edge 50*a* of the paper exit ceiling 50 slopes upward. A plurality of rectangular notches 51 is formed in the upstream edge 50*a* of the paper exit ceiling 50, and the outside surface part of a knobby roller 52 is exposed from each of the notches 51. These rollers 52 are disposed with the axis of rotation extending widthwise to the printer (widthwise to the paper) above the stage surface 40. The outside surfaces on the bottom side of the knobby rollers 52 are opposite the stage surface 40, and the outside surfaces of the knobby rollers 52 on the upstream side are opposite the movable knife 22.

Cutting and Discharging the Label Paper

Figure 6A:
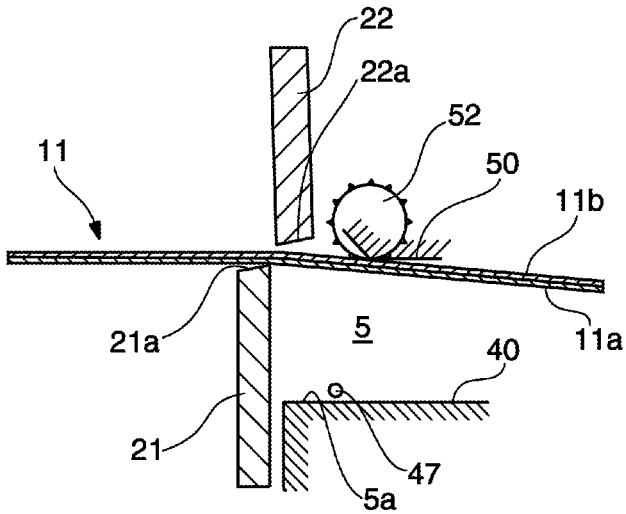
FIG. 6A shows before the paper is cut.
Figure 6B:
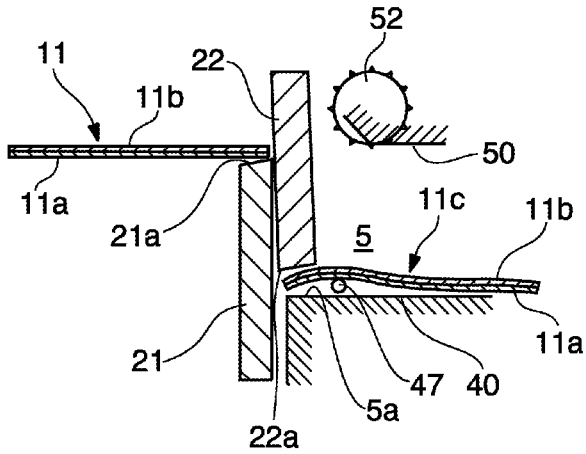
FIG. 6B shows after the paper is cut.
Figure 6C:
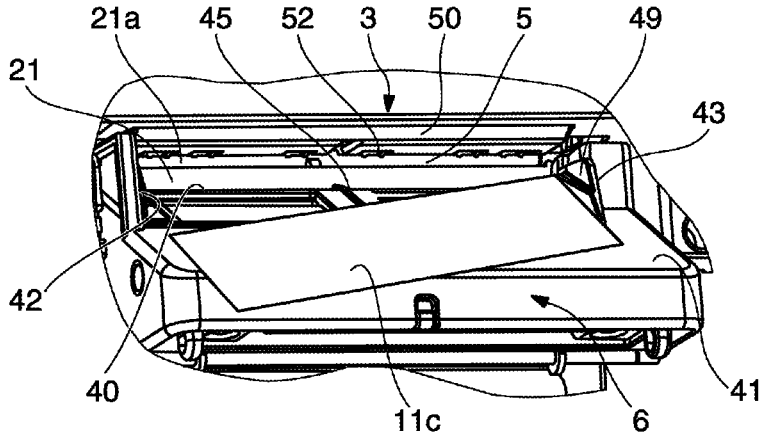
FIG. 6C shows the cut-off portion sliding down.

Cutting and discharging the label paper 11 from the paper exit 5 is described next with reference to FIG. 6. FIG. 6A schematically shows the label paper 11 passing the cutting position B, FIG. 6B shows immediately after the label paper 11 is cut, and FIG. 6C shows the cut-off portion discharged from the paper exit.

The label paper 11 printed at the printing position A is conveyed by the transportation mechanism to the position where the end of the printed portion on the label side is on the downstream side in the paper transportation direction from the cutting position B. When the label paper 11 passes the cutting position B, the label paper 11 is guided to the downstream side in the paper transportation direction of the paper exit 5 while the knobby rollers 52 rotate with the label surface in contact with the tips of the knobs on the outside surfaces of the knobby rollers 52 as shown in FIG. 6A.

As a result, the printed portion will not rub against the paper exit ceiling 50 and be soiled or otherwise damaged when the ink in the printed portion formed on the label surface of the continuous label 11*b* is not completely dry.

When the transportation operation stops, the movable knife 22 moves from the standby position C to the cutting-completed position D. As a result, the point of intersection between the cutting edge 22*a* of the movable knife 22 and the cutting edge 21*a* of the fixed knife 21 moves from one end (the pivot axis side) to the other (the distal end side of the movable knife) widthwise to the printer (widthwise to the paper), and the part of the label paper 11 positioned therebetween is cut.

When the cutting edge 22*a* of the movable knife 22 moves to below the bottom edge 5*a* of the paper exit 5 when cutting the paper, there is a problem of the movable knife 22 pushing the upstream end part of the cut-off portion 11*c* of the label paper 11 down or causing it to curl, and when the movable knife 22 returns to the standby position C, the curled part may spring back due to the returning force.

However, because the stage surface 40 that defines the bottom edge 5*a* of the paper exit 5 extends horizontally slightly below the position of the cutting edge 22*a* of the movable knife 22 when at the cutting-completed position D, the movable knife 22 does not push the upstream end part of the cut-off portion 11*c* down when moving to the cutting-completed position D, and the upstream end part of the cut-off portion 11*c* is always above the bottom edge 5*a* of the paper exit 5 as shown in FIG. 6B. The upstream end part of the cut-off portion 11*c* therefore is not caused to curl, and when cutting is complete, the upstream end part of the cut-off portion 11*c* is therefore deposited substantially flat on the stage surface 40.

When the cut-off portion 11*c* is deposited on the stage surface 40, the cut-off portion 11*c* covers the top of (rests on) the protrusion 47 projecting from the first side wall 42 and the protrusion 45 projecting from the center widthwise to the printer. As a result, the cut-off portion 11*c* is made unstable and easily loses balance as a result of the protrusion 47 and the protrusion 45 immediately after being deposited on the stage surface 40. When the cut-off portion 11*c* loses balance, it may slide down the stage surface 40 along the sloped guide surface 41 and be discharged to the outside from the paper exit 5. At this time, if the first side wall 42 side of a previously cut-off portion 11*c* drops onto the sloped guide surface 41 first, the second side wall 43 side of the cut-off portion 11*c* will ride on top of the second side wall 43, and the cut-off portion 11*c* will rest stably on the stage surface 40 and block the paper exit 5. However, because the notched step 49 is formed on the second side wall 43, the cut-off portion 11*c* does not remain on the stage surface 40, and slides down and is discharged smoothly.

Because the contact pressure of this scissor type automatic cutter 20 between the cutting edge 21*a* of the fixed knife 21 and the cutting edge 22*a* of the movable knife 22 is applied on the support shaft 38 side that is the pivot axis of the cutting edge 22*a*, the pressure weakens gradually with distance from the support shaft 38 to the other side of the printer (the distal end side of the movable knife 22). In addition, adhesive between the web liner 11*a* and the continuous label 11*b* is squeezed out from the other edge 11*d* of the label paper 11 widthwise to the printer (see FIG. 3) when the paper is cut because the label paper 11 is squeezed between the fixed knife 21 and the movable knife 22 from the support shaft 38 side, and the adhesive may stick to the edge of the fixed knife 21 or the cutting edge 22*a* of the movable knife 22 at the distal end side of the movable knife 22, and may move gradually down due to gravity, for example, and accumulate on the stage surface 40. When adhesive sticks to the stage surface 40, the adhesive can get between the cutting edge 22*a* of the movable knife 22 and the cutting edge 21*a* of the fixed knife 21, interfere with cutting and cause cutting problems.

However, because a notched opening 44 is formed in the edge part of the stage surface 40 on the other side of the paper width in this embodiment of the invention, the adhesive drops from the notched opening 44 and is removed from the stage surface 40. Adhesive therefore does not accumulate on the stage surface 40, and cutting problems are avoided.

Because protrusion 47 and protrusion 45 are disposed to a stage surface 40 that extends horizontally below the movable knife 22 in this embodiment of the invention, the cut-off portion 11*c* is deposited on the stage surface 40 from above the protrusion 47 and protrusion 45 covering or resting on the protruding parts. As a result, the cut-off portion 11*c* is rendered unstable by the protrusion 47 and protrusion 45 immediately after being deposited on the stage surface 40. When the cut-off portion 11*c* loses balance, it drops down along the sloped guide surface 41 and is discharged outside from the paper exit 5 instead of remaining on the stage surface 40. Because cut-off portions 11*c* therefore do not accumulate on the stage surface 40, a cut-off portion 11*c* does not interfere with the cutting edge 22*a* of the movable knife 22 and cause cutting problems. The movable knife 22 will also not bite into accumulated cut-off portions 11*c* and lock up.

The protrusion 47 is positioned on one side of the stage surface part 40*a* widthwise to the printer. This one widthwise side of the stage surface part 40*a* is the side of the paper web that is cut first by the pivoting movable knife 22, and is the part of the stage surface 40 on which the cut-off portion 11*c* is deposited first. Because a protrusion 47 is rendered in this part, the cut-off portion 11*c* is made unstable from the time part of it is deposited on the stage surface 40. The cut-off portion 11*c* also slides down easily along the sloped guide surface 41.

In addition, because the protrusion 47 is positioned at the upstream end part of the stage surface part 40*a*, when the cut-off portion 11*c* is deposited on the stage surface 40 covering the protrusion 47, the position of the protrusion 47 is most frequently more to the upstream end of the cut-off portion 11*c* than its center of gravity. Therefore, even if the label paper 11 is cut to a length that is short in the transportation direction, the cut-off portion 11*c* placed on the stage surface 40 easily loses balance to the downstream side, and the cut-off portion 11*c* can therefore be made to fall to the sloped guide surface 41 side.

Furthermore, because the second side wall 43 in this embodiment of the invention has a notched step 49, if the first side wall 42 side of the cut-off portion 11*c* drops onto the sloped guide surface 41 first, the second side wall 43 side drops down even if it rides onto the top of the second side wall 43. The cut-off portion 11*c* therefore does not rest stably on the second side wall 43, and does not remain on the stage surface 40.

Other Embodiments

Both a protrusion 47 and protrusion 45 are disposed to the stage surface 40 in the embodiment described above, but the cut-off portion 11*c* deposited on the stage surface 40 can be made to lose balance and drop down to the sloped guide surface 41 side even if only one of these is disposed.

Yet further, a protrusion can be rendered directly on the stage surface part 40*a* if the paper exit guide 6 does not have a first side wall 42 and a second side wall 43. If the protrusion is formed at an upstream side part on one widthwise side of the printer, the cut-off portion 11*c* will be rendered unstable as soon as the cut-off portion 11*c* is deposited on the stage surface 40.

Further alternatively, a plurality of protrusions may be formed on an upstream side part on one widthwise side of the printer.

Yet further, if a guillotine type automatic cutter in which the movable knife moves bidirectionally in a straight line to and away from the fixed knife has a stage surface defining the bottom edge of the paper exit below the cutting edge of the movable knife, the cut-off portions of paper can be discharged from the paper exit without gathering on the stage surface by rendering a protrusion or protruding part in the stage surface.

In this configuration the protruding part is preferably disposed on the upstream side part of the stage surface.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A cutter comprising:

a fixed knife;

a movable knife that moves relative to the fixed knife and cuts paper;

a paper exit from which a paper is discharged in a discharge direction, the paper having a paper width transverse to the discharged direction;

a stage surface that defines a bottom surface of the paper exit, the stage surface having a first and second side;

a first side wall on the first side of the stage surface;

a second side wall on the second side of the stage surface and opposite the first side wall;

at least one first protruding part disposed to the stage surface and the first side wall and extending transverse to the discharge direction by less than the paper width so as to support the paper over less than the width of the paper;

at least one second protruding part disposed on the stage surface and extending in the discharge direction; and an inclined guide surface formed at a downstream side of the stage surface relative to the discharge direction, the inclined guide surface extending down in the discharge direction, wherein the inclined guide surface and the at least one protruding part causes the paper to discharge in the downstream direction.

2. The cutter described in claim 1, wherein:

the at least one first protruding part is disposed downstream from the movable knife relative to the discharge direction.

3. The cutter described in claim 1, wherein:

the at least one first protruding part is disposed at a position lower than a cutting edge of the fixed knife.

4. The cutter described in claim 1, wherein:

the movable knife is configured to pivot around a pivot axis that is disposed at a pivot axis side of the stage surface; and the at least one first protruding part is disposed at least on the pivot axis side of the stage surface.

5. The cutter described in claim 4, further comprising:

a first side wall that determines a first side position of the paper on the pivot axis side of the stage surface, and is configured to be moved over the stage surface widthwise to the paper; and a second side wall that determines a second side position of the paper on a side of the stage surface opposite to the pivot axis side of the stage surface;

said at least one first protruding part being a protrusion that is disposed on the first side wall and protrudes transverse to the discharge direction toward the second side wall.

6. The cutter described in claim 4, further comprising:

a first side wall that determines a first side position of the paper on the pivot axis side of the stage surface, and is configured to be moved over the stage surface widthwise to the paper; and a second side wall that determines a second side position of the paper on a side of the stage surface opposite to the pivot axis side of the stage surface, the second side wall being oriented at a non-zero angle relative to the discharge direction; and a linkage mechanism configured to move the second side wall in conjunction with the first side wall by an equal amount in the opposite direction as the first side wall.

7. The cutter described in claim 1, wherein:

the at least one first protruding part is formed at an upstream side of the stage surface relative to the discharge direction.

8. The cutter described in claim 1, wherein:

the at least one first protruding part is an integrally-formed part of the stage surface.

9. The cutter described in claim 1, wherein:

the at least one first protruding part is a protrusion formed along the discharge direction from the stage surface to the inclined guide surface; and a top surface of said protrusion slopes down in the discharge direction.

10. A printer with a cutter, comprising:

a case defining a case side of the printer;

a cover that opens and closes to the case, the cover defining a cover side of the printer; and the cutter described in claim 1, the movable knife being disposed on the case side of the printer and the fixed knife being disposed on the cover side of the printer.

* * * * *